United States Patent [19]

Bonin

[11] 3,936,233

[45] Feb. 3, 1976

[54] FUEL INJECTION PUMPS FOR INTERNAL COMBUSTION ENGINES

[75] Inventor: Jean-Claude Bonin, Blois(Loir-et-Cher), France

[73] Assignee: Roto Diesel, Clichy (Hauts-de-Seine), France

[22] Filed: Jan. 23, 1975

[21] Appl. No.: 543,534

Related U.S. Application Data

[62] Division of Ser. No. 450,431, March 12, 1974.

[30] Foreign Application Priority Data

Mar. 14, 1973 France ..... 73.09050

[52] U.S. Cl. ..... 417/214; 417/462

[51] Int. Cl.² ..... F04B 19/02; F04B 29/00

[58] Field of Search ..... 417/214, 462

[56] References Cited

UNITED STATES PATENTS

| | | | |
|---|---|---|---|
| 3,000,318 | 9/1961 | Volossevich | 417/214 |
| 3,046,905 | 7/1962 | Davis | 417/462 |
| 3,338,168 | 8/1967 | Davis | 417/214 |
| 3,847,509 | 11/1974 | Bonin | 417/462 |
| 3,883,270 | 5/1975 | Baxter | 417/462 |

*Primary Examiner*—William L. Freeh
*Attorney, Agent, or Firm*—Finnegan, Henderson, Farabow & Garrett

[57] ABSTRACT

A fuel injection pump for supplying fuel to an internal combustion engine includes a pair of pumping plungers which are actuated by cam lobes formed on the internal periphery of an annular cam ring. Roller carrying shoes are interposed between the plungers and the cam lobes and are axially movable. The cam profile varies throughout its axial length so that variation in the axial setting of the shoes varies the amount of fuel supplied by the pump.

6 Claims, 3 Drawing Figures

FUEL INJECTION PUMPS FOR INTERNAL COMBUSTION ENGINES

This is a division of application Ser. No. 450,431, filed Mar. 12, 1974.

This invention relates to fuel injection pumps of the kind described in the specification of Patent Application No. 316,485 filed 19th Dec., 1972.

In the application referred to above there is described a fuel injection pump for supplying fuel to internal combustion engines comprises a body part, a distributor member rotatable within the body part and adapted to be driven in timed relationship with an engine with which the pump is associated, a transverse bore formed in the distributor member, a pair of pumping plungers reciprocably mounted within the bore, a pair of shoes slidable in radial slots at the outer ends of said bore, the shoes engaging the plungers during inward movement of the shoes, cam engaging means carried by said shoes, an annular cam ring surrounding said distributor, cam lobes formed on the internal periphery of said cam ring and engaging with said cam engaging means during rotation of said distributor member to impart inward movement to said shoes and plungers, fuel delivery means for conveying fuel displaced from said bore to a plurality of fuel outlets in turn, fuel inlet means for supplying fuel to said bore during the periods when the plungers can move outwardly, and means for moving the shoes axially whereby the amount of fuel which can be supplied through the fuel outlets can be varied.

According to the invention the cam lobes have different profiles throughout their axial length.

Examples of injection pumps in accordance with the invention will now be described with reference to the accompanying drawings in which.

Figure 1:
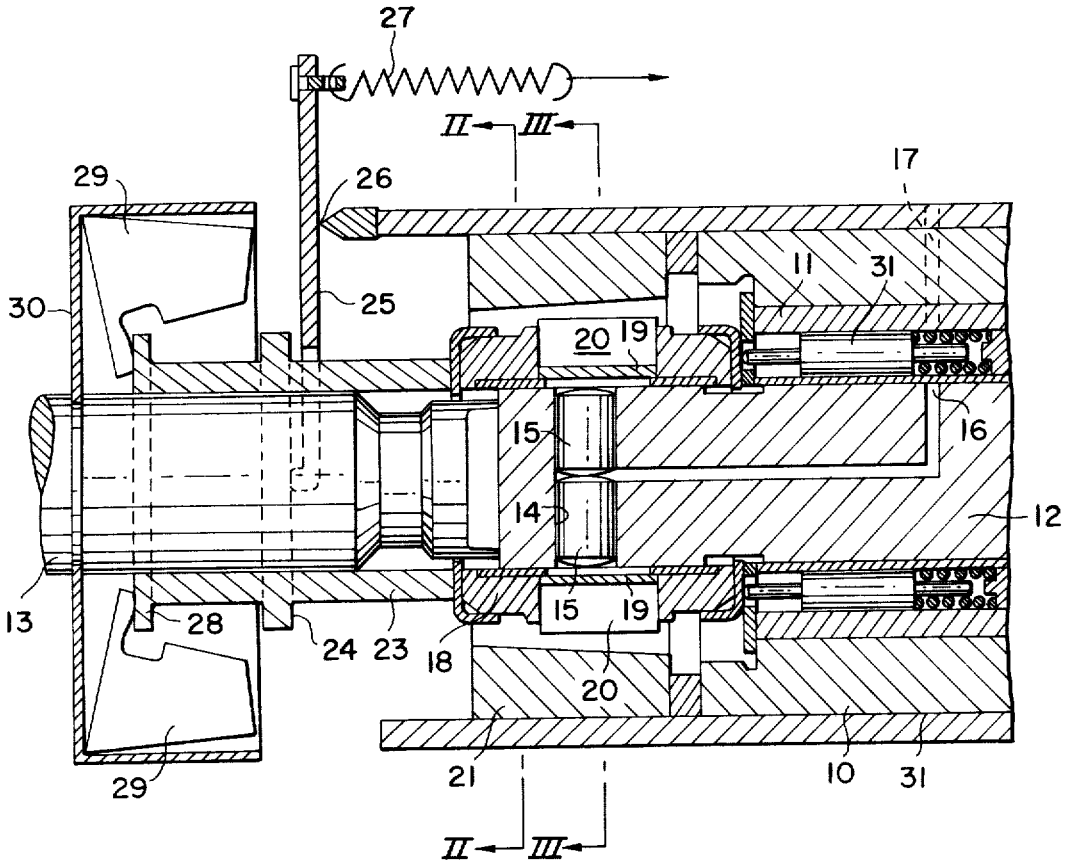
FIG. 1 is a sectional side elevation of part of one example.
Figure 2:
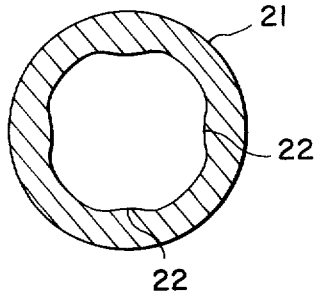
FIGS. 2 and 3 are part sections on the lines II—II and III—III of FIG. 1.
Figure 3:
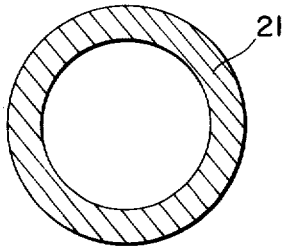

With reference to FIGS. 1, 2 and 3 of the drawings there is provided a pump body 10 defining a cylindrical cavity in which is mounted a fixed sleeve 11. Mounted within the sleeve 11 is a rotary distributor member 12 which is adapted to be driven in timed relationship with an associated engine by means of a drive shaft 13. Moreover, formed within the distributor member is a transversely extending bore 14 in which is mounted a pair of pumping plungers 15. The bore communicates with a passage 16 which in known manner communicates with fuel outlets 17 in turn, formed in the body.

Surrounding the distributor member 12 is an annular carrier 18. The carrier is axially movable on the distributor member 12 but is angularly movable therewith. The carrier is provided with a pair of radial slots in which are mounted shoes 19 which carry rollers 20. Surrounding the sleeve 19 is an annular cam ring 21 on the internal peripheral surface of which as seen in FIG. 2, are formed a plurality of cam lobes 22. The cam lobes 22 in use, are engaged by the rollers 20 to effect inward movement of the plungers 15 during the time when the passage 16 is in communication with a fuel outlet 17. Outward movement of the plungers is under the action of fuel which is supplied to the transverse bore 14 from a source of fuel under pressure.

As will be seen from FIG. 1 the cam lobes 22 are flared or tapered and the effect of this taper is that the inward movement of the plungers and therefore the amount of fuel supplied through the fuel outlet depends upon the axial setting of the annular carrier 18. In the particular arrangement as the carrier is moved towards the right as seen in FIG. 1 the amount of fuel supplied will decrease. At the section line indicated by FIG. 3 the cam lobes have tapered completely and therefore there will be no delivery of fuel.

The axial setting of the carrier 18 is controlled by an axially movable sleeve 23 slidable on the shaft 13. The sleeve 23 is provided with a first flange 24 against which bears the forked end of a lever 25. The lever 25 is pivotally mounted about a fulcrum point 26 and the other end of the lever is connected to a coiled tension spring 27 the force exerted by which can be adjusted by a manually operable device. The sleeve 23 is provided with a further flange 28 which is acted upon by the toe portions of centrifugal weights 29. The weights 29 are mounted in a cage 30 driven by the drive shaft 13. The arrangement is such that for a given setting of the manually operable device as the speed of the engine increases the sleeve 23 will move towards the right as seen in FIG. 1 and like movement will be imparted to the annular carrier 18 thereby reducing the amount of fuel supplied to the engine. In the event that the force exerted by the spring 27 is increased or the engine speed decreases, the sleeve 23 will move towards the left and the annular carrier 18 is maintained in contact with the sleeve 23 by means of the force exerted by the spring loading of rams 31 carried within the sleeve 11. It will be appreciated that the springs loading the rams 31 assist the action of the spring 27.

I claim:

1. A fuel injection pump of the kind intended for supplying fuel to internal combustion engines and comprising a body part, a distributor member rotatable within the body part and adapted to be driven in timed relationship with an associated engine, a transverse bore in the distributor member, a pair of pumping plungers reciprocally mounted within the bore, a pair of shoes slidable in radial slots at the outer ends of said bore, said shoes engaging the plungers during inward movement of the shoes, cam engaging means carried by said shoes, an annular cam ring surrounding said distributor, cam lobes formed on the internal periphery of said cam ring and engaging with said cam engaging means during rotation of the distributor member to impart inward movement to said shoes and plungers, fuel delivery means for conveying fuel displaced from said bore to a plurality of fuel outlets in turn, fuel inlet means for supplying fuel to said bore during the periods when the plungers can move outwardly, a carrier member axially slidable on the distributor member, slots in the carrier member in which are located said shoes respectively whereby axial movement of the carrier members will effect axial movement of said shoes, the cam lobes having a different profile throughout their axial length, whereby the extent of outward movement of the plungers is dependent upon the axial setting of said carrier member.

2. A pump, as claimed in claim 1, including engine speed responsive means for varying the axial setting of said carrier member.

3. A pump, as claimed in claim 2, in which said speed responsive means comprises an axially movable sleeve engaging one end of said carrier member, centrifugal weight means acting on the sleeve to urge the sleeve in one direction as the speed increases, and resilient means operatively coupled to said sleeve for opposing the movement of the sleeve by said weight means.

4. A pump, as claimed in claim 3, including rams acting to maintain said carrier member in contact with said sleeve irrespective of the direction of movement of the sleeve.

5. A pump, as claimed in claim 4, in which said rams act against the other end of said carrier member.

6. A pump, as claimed in claim 5, including resilient means loading said rams into contact with said carrier member.

* * * * *